US005493827A

United States Patent [19]

Georgeau et al.

[11] Patent Number: 5,493,827

[45] Date of Patent: Feb. 27, 1996

[54] PITCH POCKET

[75] Inventors: Philip C. Georgeau; Nancy L. Turner, both of Kalamazoo, Mich.

[73] Assignee: Consul Tech, Inc., Kalamazoo, Mich.

[21] Appl. No.: 349,501

[22] Filed: Dec. 2, 1994

[51] Int. Cl.[6] ..... E04D 13/14

[52] U.S. Cl. ..... 52/219; 52/60; 52/741.4; 52/742.13

[58] Field of Search ..... 52/219, 60, 741.4, 52/742.1, 742.13, 742.14, 58, 59; 285/42

[56] References Cited

U.S. PATENT DOCUMENTS

| | | | |
|---|---|---|---|
| 515,153 | 2/1894 | Miller | 52/219 |
| 1,494,234 | 5/1924 | Gossett . | |
| 3,708,185 | 1/1973 | Bilicki et al. . | |
| 3,838,544 | 10/1974 | Hindall . | |
| 4,635,409 | 1/1987 | Vandemore . | |
| 4,730,421 | 3/1988 | Leeland . | |
| 4,928,443 | 5/1990 | Goodman et al. . | |
| 4,934,117 | 6/1990 | Barksdale . | |
| 4,937,991 | 7/1990 | Orth . | |

*Primary Examiner*—Robert Canfield

*Attorney, Agent, or Firm*—Price, Heneveld, Cooper, DeWitt & Litton

[57] ABSTRACT

A pitch pocket for sealing a mechanical penetration of a roof includes a cementitious curb which defines a pocket having an upper edge, an inner surface and a base surface. An adhesive is applied to the base surface to secure the curb to the roof. A pourable, two-part urethane sealant is cast within the pocket to form a solid seal around the roof penetration with the curb.

24 Claims, 1 Drawing Sheet

PITCH POCKET

BACKGROUND OF THE INVENTION

The invention relates to a pitch pocket or pan for sealing mechanical penetrations in a waterproof membrane covering a roof substrate.

In a typical low slope, single-ply membrane roof, provision must be made for sealing penetrations of the roof by vent pipes, support straps, conduits, guy anchors and similar elements. Generally, a pitch pocket or pan which surrounds the penetrating element is used. A sealant is poured into the pan around the penetrating element. Various types of pitch pockets or pans have been proposed. Examples may be found in U.S. Pat. No. 3,838,544 entitled *Adjustable Pitch Pocket Structure*, which issued on Oct. 1, 1974, to Hindall; U.S. Pat. No. 4,928,443 entitled *Pourable Sealer Pocket*, which issued on May 29, 1990, to Goodman et al.; U.S. Pat. No. 4,934,117 entitled *Pitch Pocket and Method of Forming Same*, which issued on Jun. 19, 1990, to Barksdale; and U.S. Pat. No. 4,937,991 entitled *Flashing Unit for Sealing Roof Penetrations*, which issued on Jul. 3, 1990, to Orth.

In one approach, a prefabricated angle iron flange, at least two inches deep, is fabricated away from the job site. The flange is bonded to the roofing membrane with a solvent-based contact cement, thus forming a metal dam around the roof penetration. Sheet rubber flashing is applied to the outer surfaces of the flange with contact cement to prevent rusting and corrosion. The perimeter of the applied rubber flashing is then sealed with a bead of solvent-based rubber caulking to keep it from being underridden by water. A two-part urethane rubber pourable sealant is mixed and poured into the cavity until it is level with the top of the metal flange. The liquid rubber cures to form a solid rubber seal around the roof penetration.

The installation of available pitch pans is time consuming, complicated and expensive. The process generally takes about 45 minutes per unit and is labor intensive. The complexity of the procedure under field conditions has caused errors in workmanship and improper installations, leading to failure of the seal formed by the pitch pan. Because of the time and expense associated with traditional pitch pans, many contractors have compensated by filling the pan cavity with sand, mortar or urethane foam and covering the top surface with caulk to give the appearance of a solid rubber seal. These practices have lead to frequent leaks and failures that make traditional pitch pans unreliable. Therefore, a need exists for a pitch pocket and installation method which simplifies field application, which reduces the cost of materials and which provides for a more reliable waterproof seal between a roof membrane and penetration therein than heretofore achieved.

SUMMARY OF THE INVENTION

In accordance with the present invention, the aforementioned needs are fulfilled. Essentially, a pitch pocket or pan is provided which includes a preformed curb defining a pocket having an upper edge and a base surface. An adhesive is applied to the base surface to secure the curb to the roof about a roof penetration. A pourable sealant is cast within the pocket to form a solid seal with the curb around the penetration.

In the preferred form, the curb is formed from at least two curb elements, each of which define opposed, joint surfaces. Adhesive is also applied to the joint surfaces to join the elements to form the curb.

In further aspects of the invention, the curb is preformed or cast from a lightweight, polymer-modified portland cement. In addition, it is presently preferred that the lightweight cement composition include up to forty-percent expanded shale to impart a texture to the bottom surface of the curb and to reduce the weight and density of the curb element. In still further aspects of the invention, the curb elements define a curved outer surface to shed water and keep ice away from the cast sealant.

A pitch pocket in accordance with the present invention secures and waterproofs mechanical roof penetrations formed by pipes and structural members, for example, through single-ply membrane roofing. The system or pitch pan is easier to install and is less costly than current approaches. Rubber flashings and the like heretofore necessary to protect exterior surfaces of pitch pans are eliminated. The pan is strong, durable and provides mechanical protection for the contained cast sealant. A pitch pan in accordance with the present invention is impervious to corrosion, ultraviolet light and the rigors of roof-top environments. The pan is readily useable with a wide variety of roof systems.

DETAILED DESCRIPTION OF THE PREFERRED EMBODIMENT

Figure 1:
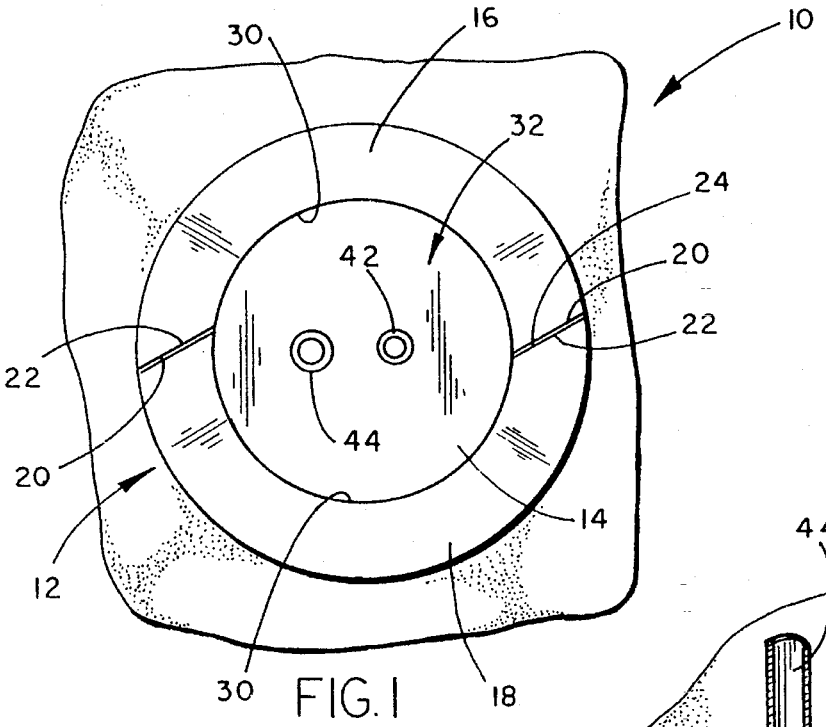
FIG. 1 is a top, plan view of a pitch pocket in accordance with the present invention.
Figure 2:
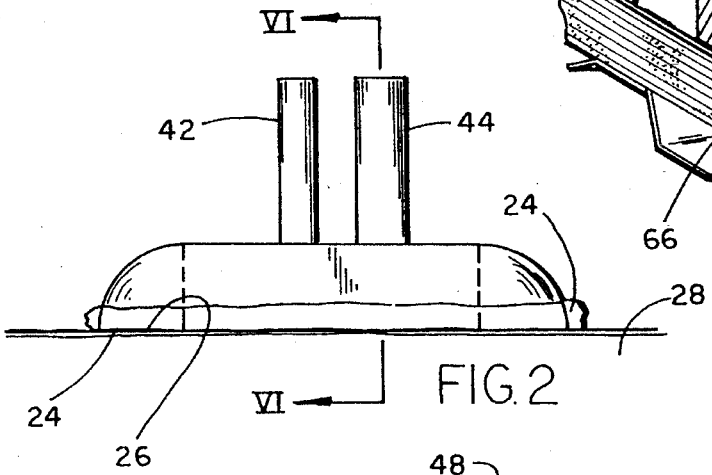
FIG. 2 is a side, elevational view of the pitch pocket of FIG. 1.
Figure 6:
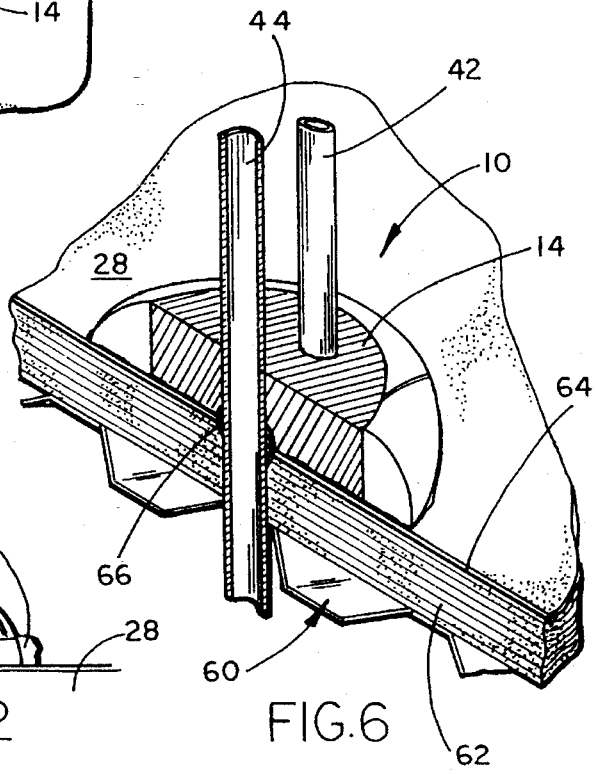
FIG. 6 is a cross-sectional view taken generally along the lines VI—VI of FIG. 2.
Figure 3:
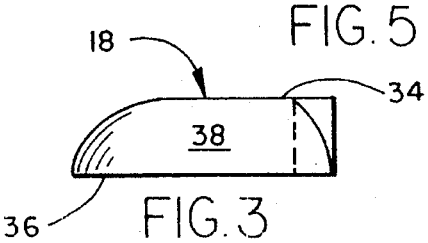
FIG. 3 is a side, elevational view of a curb element incorporated in the pitch pocket of FIG. 1.
Figure 4:
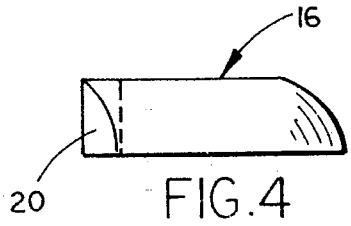
FIG. 4 is a side, elevational view of another curb element incorporated in the pitch pocket.

A preferred embodiment of a pitch pocket or pourable pitch pan in accordance with the present invention is illustrated in FIGS. 1, 2 and 6 and generally designated by the numeral 10. Pitch pan 10 includes a curb 12 and a pourable, cast sealant 14. In a presently preferred form, curb 12 is defined by a pair of curved, semicircular curb elements 16, 18. Curb elements 16, 18 define opposed, angled joint faces 20, 22. Faces 20, 22 are formed on a diagonal or are angled with respect to the centerline of each element. As is best seen in FIGS. 1, 3 and 4, curb elements 16, 18 are complimentary or mirror images of each other. When positioned with joint surfaces 20, 22 in abutting relationship, as shown in FIG. 1, the curb elements define circular curb 12. In the preferred form, the curb elements are joined by an adhesive 24 which is applied to the joint surfaces 20, 22. Adhesive 24 is applied to an undersurface or base surface 26 of each ring element 16, 18. The adhesive secures the curb 12 to a roof surface 28. Adhesive 24 may also be applied as a bead around the periphery or lower edge of curb 12, as shown in FIG. 2.

Elements 16, 18 each include an inner peripheral surface 30. When the elements are joined together and positioned on roof 28, the curb defines a pocket 32 which receives sealant 14. Elements 16, 18, in the embodiment illustrated, are semicircular in plan view. In cross-sectional view, each element includes an upper peripheral edge 34. Edge 34 is joined to an outer edge 36 of base surface 26 by a smoothly curved surface 38.

Curb 12 is formed with the two components 16, 18 to simplify installation. The two halves may readily be placed around a roof penetration such as pipes 42, 44 as shown in FIGS. 1, 2 and 6. The ring shape of the preferred curb reduces the quantity of sealant 14 necessary to fill pocket 32 than would be required if the curb had a rectangular configuration.

Figure 5:
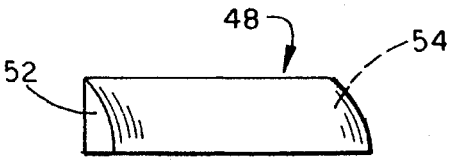
FIG. 5 is a side, elevational view of a third element which may be used in the pitch pocket.

Sections 16, 18 can form ends of an enlarged pocket formed by inserting straight curb elements 48, as seen in FIG. 5, therebetween. Elements 48 include complimentary joint surfaces 52, 54 configured to mate with joint surfaces 20, 22 of the individual elements 16, 18. Straight elements 48 are cast in complimentary or mirror image configurations to be positioned between elements 16, 18 to form the enlarged pocket having curved ends and straight, parallel sides. Elements 48, therefore, permit ready expansion of the pocket size to accommodate several penetrations.

Individual elements 16, 18 and 48 are preformed or cast from a lightweight cementitious composition. The composition of the elements provides mechanical protection for the contained sealant 14. The cementitious elements are impervious to corrosion, ultraviolet light and the rigors of roof-top environments. The elements in accordance with the present invention eliminate the need for separate EPDM coverings or the use of other sheet rubber flashing to prevent corrosion. The configuration of the elements, including the curved outer surfaces, allows the curb or pocket element to shed water and keep ice away from the internal rubber seal. In a presently existing embodiment, the curb has a width "w" of 2 inches, a height "h" of 2 inches and an outer diameter of 11.5 inches. It is presently preferred that the height be at least 2 inches. When filled with sealant, the curb raises the point of entry of the roof penetration the same height above the roofline and away from standing water. Standard preformed rings are usable to accommodate the majority of roof penetrations typically encountered.

Various lightweight portland cement compositions may be used. Examples of acceptable compositions are provided by the following formulas:

| | (A) | (B) |
|---|---|---|
| Portland Cement Type I A | 30.0% | 30.0% |
| Calcium Carbonate 20 mesh | 40.0 | 0.0 |
| Expanded Shale | 0.0 | 40.0 |
| Chopped Glass Fiber | 2.0 | 2.0 |
| Water | 16.0 | 16.0 |
| Lignosulfonic Acid | 0.2 | 0.2 |
| WE 551 - 15% Acrylic Microballoons | 1.8 | 1.8 |
| E 330 Rohm & Haas Acrylic Latex | 10.0 | 10.0 |
| | 100.0% | 100.0% |
| Average Density (lbs./ft$^3$) | 85.0 | 70.0 |

It is presently preferred that formula B, which incudes expanded shale, be used. The shale imparts a texture to the bottom of the preformed or cast parts. Formula B has a lower density than formula A.

A typical installation in accordance with the present invention is illustrated in FIGS. 1, 2 and 6. As shown, the pitch pocket 10 is installed on a roof substrate which includes a steel deck 60. Deck 60 is covered by sheets of insulation 62. A waterproof membrane 64 is applied to the roof over the insulation 62. Pipes or other penetrations 42, 44 extend through the steel deck 60, insulation 62 and the waterproof rubber membrane 64. Membrane 64 is cut at 66 to allow the penetrating member to pass through. The membrane is then bonded in place to insulation 62 leaving small flaps projecting up around the penetration and, hence, into the pan. Gaps between the penetration and adjacent material are sealed with adhesive. The adhesive prevents liquid sealant from draining out of the pan through the cut membrane.

Pitch pan 10 provides a durable and lasting waterproof seal at the penetration in the membrane 64. To install the pitch pocket in accordance with the present invention, individual elements 16, 18 and straight elements 48, if needed, are positioned around the penetration. Adhesive 24 is applied to the joint surfaces and the base surfaces. The separate curb elements allow assembly of the pocket about a pipe system, for example, that is already connected to roof top equipment. Elements 16, 18 are joined to form a single curb, and the curb is secured on upper surface 28 of membrane 64. The adhesive seals the joints defined by the elements and firmly secures the curb to the membrane. A bead of adhesive may also be applied around the periphery of the curb. Next, sealant 14 is poured into pocket 32 defined by the curb. The pocket is filled to the upper edge 34 of the curb. It is presently preferred that a two-part pourable urethane sealant be mixed and poured into the pocket. Such a sealant sets in approximately two hours to form a solid composite seal with the perimeter or inner surface 30 of the curb.

The curb raises the point of entry of the penetration through the roof two or more inches above the roof surface 28 and away from standing water. The curb provides support and protection for the rubber sealant contained within the pocket. The pitch pocket may be installed in less than 15 minutes. Due to its simplicity, the system minimizes errors in workmanship and reduces costs while providing an improved and permanent seal around penetrations in the roof membrane.

It is presently preferred that adhesive 24 applied to the joint surfaces, the undersurface of curb 12 and around the periphery be a cartridge grade, moisture-curing, mastic adhesive. Because the cement composition contains at least five-percent free moisture, the adhesive can cure even when atmospheric moisture is inaccessible in a closed assembly. The adhesively joined elements 16, 18 obtain sufficient strength to maintain their position within five to ten minutes after being moved into an abutting relationship. Adhesive used in bonding the cement components to each other and to the roof membrane are well known in the art. Adhesives which have been found to be effective are Polymeric Systems silicone 635 and 641. In addition, Dow Corning silicone 799 and Chem Rex urethane NP-1 adhesives are effective bonding agents. Uniroyal 6329 solvent-based EPDM sealant will provide good adhesion to single-ply membranes. The Uniroyal EPDM sealant is, however, the least preferred because of its slow set time.

The pitch pocket in accordance with the present invention readily forms seals around penetrations in roofing materials. The curved configuration of elements 16, 18, in conjunction with elongated or straight elements, coordinate the geometry of the pitch pan to form elongated and rectangular pitch pans for multiple entry penetrations in roofing materials. The cement curb and containment system will not corrode or deteriorate in roof-top environments. Separate rubber flashing on the exterior surface of curb 12 is not needed to protect it from the elements. A simple and improved bonding system is used which uses the inherent moisture in the cementitious curb to complete a chemical cure in a closed assembly. The composition in accordance with the present invention forms strong, durable and lightweight containment curbing for the pitch pan. Efficient pitch pan assembly is achieved which substantially reduces the time and labor involved in installation. The curved pitch pan curb replaces square and rectangular metal pitch pans. This results in a more efficient circular geometric form that uses less pourable rubber sealant to seal an equivalent penetration member. In addition, the pitch pan is aesthetically pleasing due to its rounded shoulders and more streamlined appearance over the sheet metal pitch pans presently used.

In view of the above description, those of ordinary skill in the art may envision various modifications which would not depart from the inventive concepts disclosed herein. For example, the pitch pocket is useable with built-up asphalt roofing and cement and metal roof structures in addition to the illustrated EPDM membrane roof. The above description should, therefore, be considered as only that of the preferred embodiments. The true spirit and scope of the present invention may be determined by reference to the appended claims.

The embodiments of the invention in which an exclusive property or privilege is claimed are defined as follows:

1. A pitch pocket for sealing a mechanical penetration of a roof, said pitch pocket comprising:

a cementitious curb, said curb defining a pocket having an upper edge and an inner surface, said curb further defining a base surface;

an adhesive applied to the base surface and adapted to secure the curb to the roof; and a pourable sealant cast within said pocket and forming a solid seal around the penetration.

2. A pitch pocket as defined by claim 1 wherein said curb is a lightweight element having an average density within the range of 70 to 85 pounds per cubic foot.

3. A pitch pocket as defined by claim 1 wherein said adhesive is a cartridge grade, moisture-curing, mastic adhesive.

4. A pitch pocket as defined by claim 3 wherein said curb is cast from a cement composition containing at least five-percent free moisture.

5. A pitch pocket as defined by claim 4, wherein said cement composition of said curb has an average density within the range of 70 to 85 pounds per cubic foot.

6. A pitch pocket as defined by claim 5 wherein said cement composition of said curb includes up to forty-percent expanded shale.

7. A pitch pocket as defined by claim*6 wherein said pourable sealant is a two-part urethane rubber sealant poured into said pocket level with the upper edge of said pocket.

8. A pitch pocket as defined by claim 1 wherein said curb defines a curved outer surface extending from the upper edge of said pocket to a lower, outer peripheral edge of said base surface.

9. A pitch pocket as defined by claim 8 wherein said curb includes at least two curb elements having opposed joint surfaces, said adhesive also being applied to said joint surfaces to join said elements.

10. A pitch pocket as defined by claim 9 wherein said curb elements are cast from a lightweight, polymer-modified portland cement.

11. A pitch pocket as defined by claim 10 wherein said curb further comprises at least two elongated elements joined to said curb elements with said adhesive applied to joint surfaces of said elongated elements and said curb elements.

12. A pitch pocket as defined by claim 10 wherein said joint surfaces of said curb elements are angled with respect to a centerline of said elements.

13. A pitch pocket as defined by claim 12 wherein said curb is a lightweight element having an average density within the range of 70 to 85 pounds per cubic foot.

14. A pitch pocket as defined by claim 13 wherein said adhesive is a moisture-curing, mastic adhesive.

15. A pitch pocket as defined by claim 14 wherein said curb is cast from a cement composition containing at least five-percent free moisture.

16. A pitch pocket as defined by claim 15 wherein said cement composition of said curb includes up to forty-percent expanded shale.

17. A sealant pan comprising:

first and second semicircular ring elements, said ring elements defining opposed, diagonal joint surfaces, inner peripheral surfaces, base surfaces and a curved, outer surface;

an adhesive on said joint surfaces for joining said elements together, said elements defining a pocket; and a cast sealant within said pocket.

18. A sealant pan as defined by claim 17 wherein said ring elements are fabricated from a lightweight, polymer-modified cement composition.

19. A sealant pan as defined by claim 18 further including adhesive on said base surfaces to secure the elements to a roof.

20. A sealant pan as defined by claim 19 wherein said adhesive on said joint surfaces and said base surfaces is a moisture-curing, mastic adhesive.

21. A sealant pan as defined by claim 20 wherein said cement composition includes expanded shale.

22. A sealant pan as defined by claim 21 wherein said cement composition includes acrylic microballoons and acrylic latex.

23. A sealant pan as defined by claim 22 wherein said cement composition contains at least five-percent free moisture.

24. A method of waterproofing an opening in a roof formed by a penetration, comprising the steps of:

placing at least a pair of cementitious curb elements around the penetration;

joining the curb elements together in opposed relationship by applying an adhesive to joint surfaces of the elements;

securing the elements to the roof by applying adhesive to an undersurface of the elements;

mixing a two-part urethane rubber sealant;

pouring the sealant into a pocket defined by the curb elements around the penetration; and allowing the sealant to cure to seal and waterproof the roof at the opening.

* * * * *